US011299845B2

(12) United States Patent
Lee et al.

(10) Patent No.: US 11,299,845 B2
(45) Date of Patent: Apr. 12, 2022

(54) WASHING MACHINE

(71) Applicant: Samsung Electronics Co., Ltd., Suwon-si (KR)

(72) Inventors: Do Yun Lee, Yongin-si (KR); Jong-Hun Sung, Suwon-si (KR); Seung Youp Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 239 days.

(21) Appl. No.: 15/845,040

(22) Filed: Dec. 18, 2017

(65) Prior Publication Data

US 2018/0179691 A1 Jun. 28, 2018

(30) Foreign Application Priority Data

Dec. 23, 2016 (KR) ..... 10-2016-0178592

(51) Int. Cl.

| | |
|---|---|
| ***D06F 39/08*** | (2006.01) |
| ***D06F 23/02*** | (2006.01) |
| ***D06F 23/04*** | (2006.01) |
| ***D06F 31/00*** | (2006.01) |
| *D06F 29/00* | (2006.01) |

(52) U.S. Cl.

CPC ..... *D06F 39/083* (2013.01); *D06F 23/02* (2013.01); *D06F 23/04* (2013.01); *D06F 31/00* (2013.01); *D06F 39/085* (2013.01); *D06F 29/00* (2013.01)

(58) Field of Classification Search

CPC ..... D06F 21/02; D06F 21/06; D06F 23/02; D06F 23/04; D06F 29/00; D06F 31/00; D06F 39/08; D06F 39/083; D06F 39/085

See application file for complete search history.

(56) References Cited

U.S. PATENT DOCUMENTS

| | | | | |
|---|---|---|---|---|
| 3,206,267 | A * | 9/1965 | Gruner | D06F 37/269 312/228 |
| 4,307,588 | A * | 12/1981 | Smith | D06F 39/12 312/257.1 |
| 2005/0196294 | A1 | 9/2005 | Clark et al. | |
| 2010/0064736 | A1 | 3/2010 | Jeong et al. | |
| 2010/0269266 | A1* | 10/2010 | Lee | D06F 29/00 8/159 |
| 2010/0275386 | A1 | 11/2010 | Ko et al. | |

(Continued)

FOREIGN PATENT DOCUMENTS

| | | |
|---|---|---|
| CN | 101113557 | 1/2008 |
| CN | 101876137 | 11/2010 |

(Continued)

OTHER PUBLICATIONS

Extended European Search Report dated Feb. 9, 2018 in European Patent Application No. 17204429.9.

(Continued)

*Primary Examiner* — David G Cormier

(74) *Attorney, Agent, or Firm* — Staas & Halsey LLP

(57) ABSTRACT

Disclosed is a washing machine including a first housing in which a first tub is disposed and a second housing in which a second tub is disposed. In the washing machine, a drain pump of the second tub may be disposed at the first housing to efficiently utilize internal spaces of the first housing and the second housing.

18 Claims, 6 Drawing Sheets

(56) References Cited

U.S. PATENT DOCUMENTS

| | | | | |
|---|---|---|---|---|
| 2011/0214456 | A1* | 9/2011 | Jang | D06F 39/083 68/12.19 |
| 2012/0255330 | A1* | 10/2012 | Wanweerakul | D06F 39/083 68/208 |
| 2016/0047079 | A1 | 2/2016 | Maiero | |
| 2017/0356115 | A1* | 12/2017 | Choi | D06F 37/22 |
| 2018/0023240 | A1* | 1/2018 | Xu | D06F 39/08 248/636 |

FOREIGN PATENT DOCUMENTS

| | | | |
|---|---|---|---|
| CN | 105316889 | | 2/2016 |
| CN | 106149276 | | 11/2016 |
| EP | 1882768 | | 1/2008 |
| EP | 2298982 | A2 | 3/2011 |
| EP | 2298982 | A3 | 3/2011 |
| KR | 20-1997-0001669 | | 3/1997 |
| KR | 10-1486359 | | 1/2015 |
| WO | 2016/169526 | A1 | 10/2016 |

OTHER PUBLICATIONS

International Search Report dated Mar. 13, 2018 in International Patent Application No. PCT/KR2017/013812.
European Office Action dated Jan. 31, 2020 in European Patent Application No. 17204429.9.
Chinese Office Action dated Nov. 4, 2019 in Chinese Patent Application No. 201711345408.2.
European Office Action dated Nov. 5, 2021 from European Application No. 17204429.9.

* cited by examiner

WASHING MACHINE

CROSS-REFERENCE TO RELATED APPLICATION

This application claims the benefit of Korean Patent Application No. 10-2016-0178592, filed on Dec. 23, 2016 in the Korean Intellectual Property Office, the disclosure of which is incorporated herein by reference.

BACKGROUND

1. Field

Embodiments of the present disclosure relate to a washing machine, and more particularly, to a washing machine including a plurality of washers.

2. Description of the Related Art

Generally, a washing machine is an apparatus which washes laundry by rotating a cylindrical rotating tub in which the laundry is accommodated. Washing machines include a washing machine which washes laundry by horizontally disposing a rotating tub such that laundry is lifted upward along an inner circumference of the rotating tub and falls down when the rotating tub rotates on a horizontal axis and a washing machine in which a rotating tub including a pulsator is vertically disposed and which washes laundry using water currents generated by the pulsator when the rotating tub rotates on a vertical axis.

The washing machine including the horizontally disposed rotating tub is referred to as a front-loading washing machine due to a laundry insertion hole formed at a front thereof. The washing machine including the vertically disposed rotating tub is referred to as a top-loading washing machine due to a laundry insertion hole formed at a top thereof.

Meanwhile, since a general washing machine has a single washer, a user should operate the washing machine two or more times when the user wants to separate and wash laundry. Accordingly, even though there is a relatively small amount of laundry, the user should operate the washing machine for a long time.

SUMMARY

Therefore, it is an aspect of the present disclosure to provide a washing machine including a plurality of washers.

It is another aspect of the present disclosure to provide a washing machine which includes a first housing in which a first tub is disposed and a second housing in which a second tub is disposed and which is mounted above the first housing. Here, a drain pump of the second tub is disposed in the first housing.

Additional aspects of the present disclosure will be set forth in part in the description which follows and, in part, will be obvious from the description, or may be learned by practice of the present disclosure.

In accordance with one aspect of the present disclosure, a washing machine includes a first housing in which a first tub is disposed the first housing having an open top, a second housing in which a second tub is disposed the second housing having an open bottom, and a drain pump disposed in the first housing the drain pump configured to drain water from the second tub.

The second housing may be mounted on an upper portion of the first housing, and the drain pump may be mounted in the upper portion of the first housing.

The washing machine may further include a connecting hose to connect the second tub to the drain pump. Here, the drain pump may include an inlet pipe to which the connecting hose is connectable, and the first housing may include an opening provided to allow the connecting hose and the inlet pipe to be accessed from an outside of the first housing.

The first housing may further include a cover capable of opening and closing the opening of the first housing.

The washing machine may further include a pump bracket capable of mounting the drain pump in the first housing. Here, the pump bracket may include a pump coupler to which the drain pump is coupleable, and a housing coupler coupleable to the first housing.

The first housing may include a side panel which forms a side surface of the first housing and a rear panel which forms a rear surface of the first housing, and the housing coupler of the pump bracket may be connected to a top end of a corner to which the side panel and the rear panel of the first housing are connected.

The first housing may further include a coupling flange provided at a top end of the side panel or the rear panel, and the pump bracket may further include a flange through hole provided at the housing coupler and through which the coupling flange passes through.

The pump bracket may further include a vibration elimination member mounted on the housing coupler, and the vibration elimination member may be disposed between the housing coupler and the first housing.

The vibration elimination member may include an elastic material.

The washing machine may further include a drain hose which guides water pumped by the drain pump to the outside of the washing machine. Here, the drain pump may further include an outlet pipe to which the drain hose is connectable, and the first housing may include a drain bracket disposed passing through the first housing and to which the drain hose is connectable.

The first tub may include an opening for inserting laundry, at a front thereof, and the second tub may include an opening for inserting laundry, at a top thereof.

In accordance with one aspect of the present disclosure, a washing machine includes a lower area comparted by a first housing, an upper area comparted by a second housing, and a drain pump disposed in the lower area and the drain pump configured to drain water from a tub disposed in the upper area.

The first housing may include a side panel which forms a side surface of the first housing and a rear panel which forms a rear surface of the first housing. The drain pump may be mounted at a top of the side panel or rear panel, and the side panel or the rear panel of the first housing may include an opening formed at a position at which the drain pump is disposed, to allow the drain pump to be accessible from an outside of the first housing.

The first housing may further include a cover capable of opening and closing the opening and a cover coupler to which the cover is couplable, and the cover may include a latch which is insertable into the cover coupler.

The first housing may further include a drain bracket disposed at the side panel or the rear panel and to which a drain hose, which guides water pumped by the drain pump to the outside of the washing machine, is connected.

In accordance with one aspect of the present disclosure, a washing machine includes a first housing in which a first tub is disposed the first housing having an open top, a second housing in which a second tub is disposed the second housing having an open bottom, a drain pump configured to drain water stored in the second tub to an outside of the second housing, and a pump bracket which connects the drain pump to the first housing or the second housing. Here, at least part of the pump bracket is disposed between the first housing and the second housing.

In accordance with one aspect of the present disclosure, a washing machine includes a first housing in which a first tub is disposed the first housing having an open top, a second housing in which a second tub is disposed the second housing having an open bottom, a drain pump configured to drain water stored in the second tub to an outside of the second housing, and a pump bracket which supports the drain pump to allow the drain pump to be disposed in the first housing or the second housing. Here, a position at which the pump bracket is coupled to the first housing or a position at which the pump bracket is coupled to the second housing is higher than a position of a lowermost part of the drain pump.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
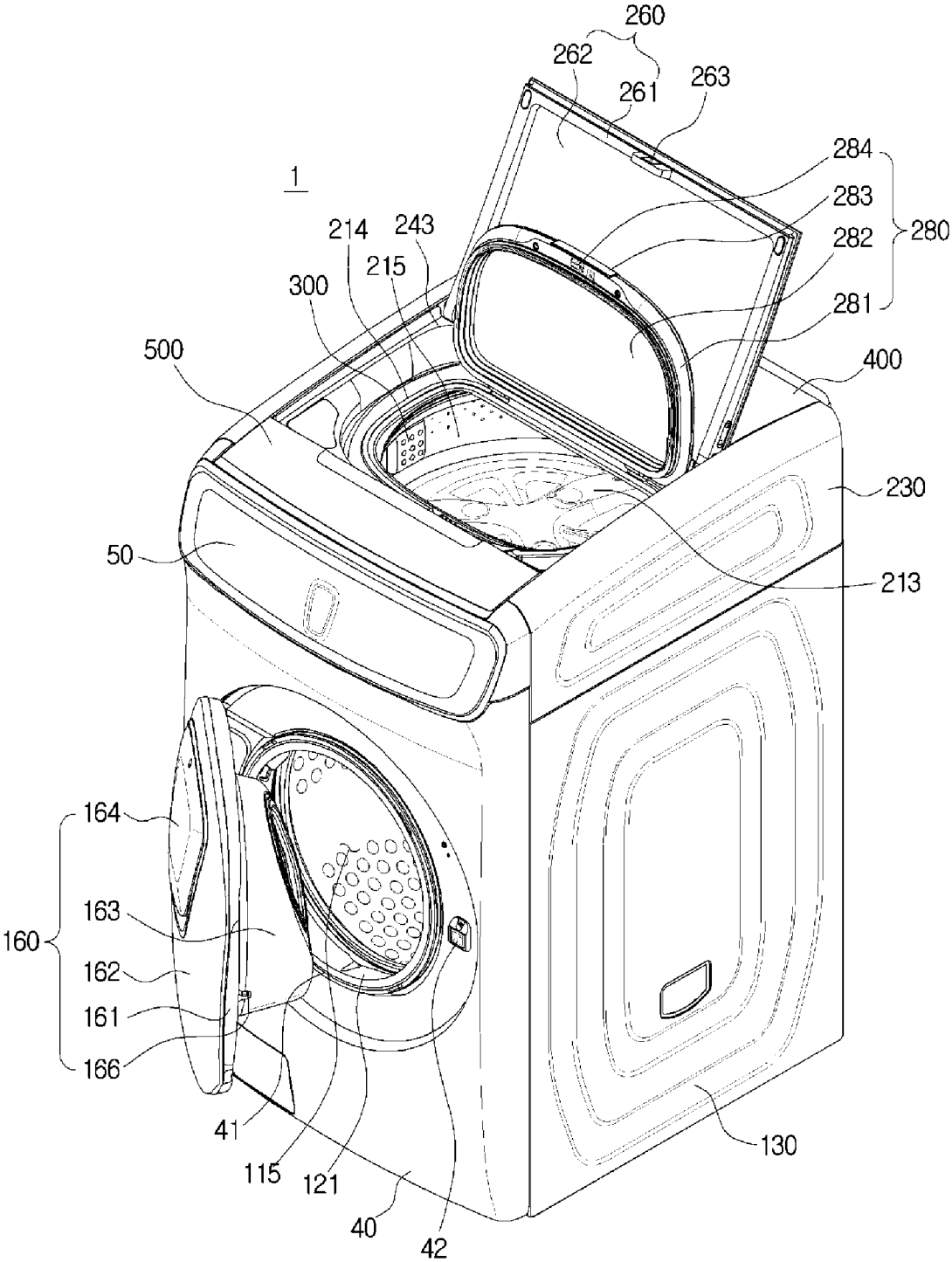
FIG. 1 is a perspective view of a washing machine according to an embodiment of the present disclosure.

Embodiments disclosed in the specification and components shown in the drawings are merely preferable examples of the present disclosure and various modifications capable of replacing the embodiments and drawings of the specification may be made at the time of filing the present application.

Also, throughout the drawings of the present specification, like reference numerals or symbols refer to components or elements configured to perform substantially identical functions.

Also, the terms used herein are to explain the embodiments but are not intended to limit and/or define the present disclosure. Singular forms, unless defined otherwise in context, include plural forms. Throughout the specification, the terms "comprise", " have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first", "second", and the like may be used for describing various components, the components will not be limited by the terms and the terms are used only for distinguishing one element from others. For example, without departing from the scope of the present disclosure, a first component may be referred to as a second component, and similarly, the second component may be referred to as the first component. The term "and/or" includes any and all combinations or one of a plurality of associated listed items.

Hereinafter, the embodiments will be described in detail with reference to the attached drawings.

Figure 2:
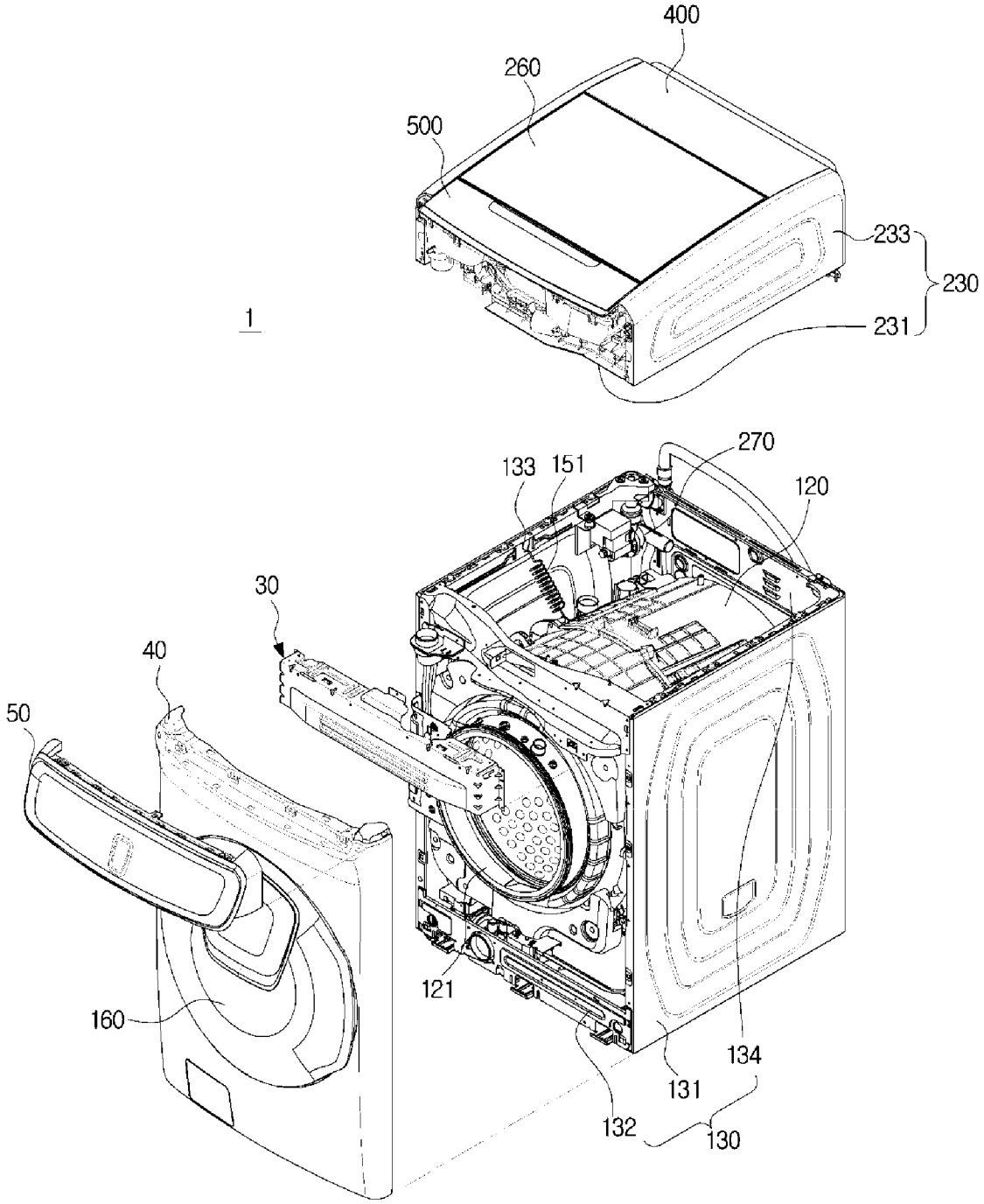
FIG. 2 is an exploded view illustrating some components of the washing machine shown in FIG. 1.
Figure 3:
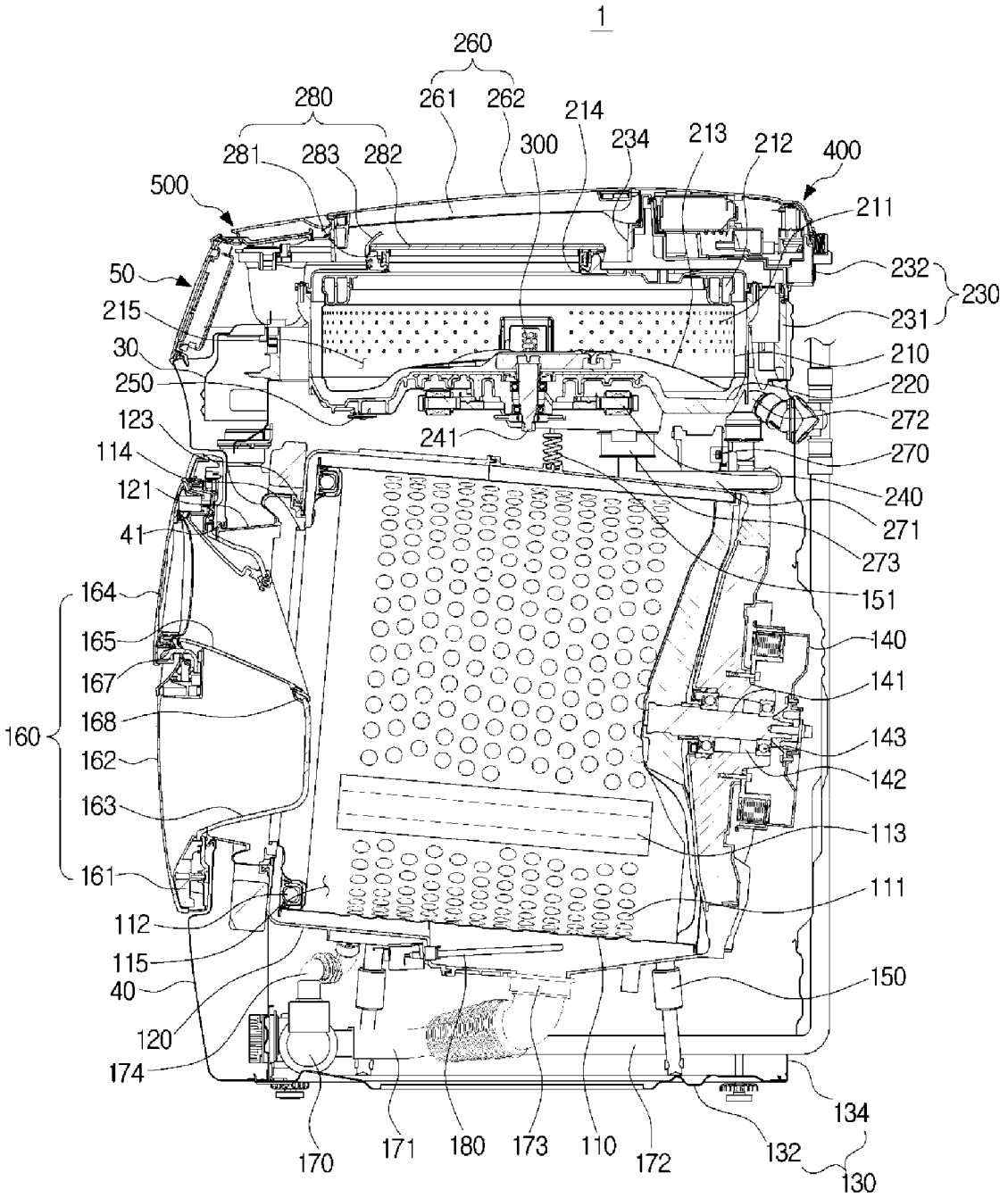
FIG. 3 is a cross-sectional view of the washing machine shown in FIG. 1.

FIG. 1 is a perspective view of a washing machine according to an embodiment of the present disclosure. FIG. 2 is an exploded view illustrating some components of the washing machine shown in FIG. 1. FIG. 3 is a cross-sectional view of the washing machine shown in FIG. 1.

As shown in FIGS. 1 to 3, a washing machine 1 may include a front-loading type first washer which includes a laundry insertion hole formed at a front of a first washing space 115 and a top-loading type second washer which includes a laundry insertion hole formed at a top of a second washing space 215.

The washing machine 1 may include a first drum 110 in which the first washing space 115 is formed and a first tub 120 which accommodates the first drum 110 and stores washing water or rinsing water to be used in a washing operation or a rinsing operation. The first drum 110 and the first tub 120 may have a cylindrical shape with at least partially opened one surface and may be disposed to allow the opened one surface to face frontward. In detail, the first drum 110 may include an opening 114 for inserting laundry at a front thereof, and the first tub 120 may include an opening 123 for inserting laundry at a front thereof.

The washing machine 1 may include a first housing 130 in which the first drum 110 and the first tub 120 are disposed. In detail, the first housing 130 with an open top may include a pair of first side panels 131 which form side surfaces of the first housing 130, a rear panel 134 which forms a rear surface, and a bottom panel 132 which forms a bottom surface. The first side panels 131 and the rear panel 134 may be integrated.

Also, the washing machine 1 may include a spring 151 and a damper 150, capable of supporting the first tub 120 to the first housing 130. The damper 150 may connect an outer surface of the first tub 120 to the bottom panel 132 to support the first tub 120 at a bottom thereof, and the spring 151 may connect the outer surface of the first tub 120 to spring couplers 133 provided at a top of the first side panels 131 to support the first tub 120 at a top thereof. The spring 151 and the damper 150 may buffer vibrations, noises, and shocks, which occur due to a movement of the first tub 120.

Installation positions of the spring 151 and the damper 150 are not limited to the top of the first side panels 131 and the bottom panel 132, and one surface of the first tub 120 and another part of the first housing 130 may be connected to support the first tub 120.

The washing machine 1 may include a first driving motor 140 disposed in the rear of the first tub 120 to rotate the first drum 110. A first driving shaft 141 for transmitting power of the first driving motor 140 may be connected to a rear surface of the first drum 110.

A plurality of through holes 111 for a flow of washing water may be formed at a circumference of the first drum 110. A plurality of lifters 113 may be installed at an inner circumferential surface of the first drum 110 to allow laundry to move upward and fall down when the first drum 110 rotates. A first balancer 112 may be mounted on a front of the first drum 110 to allow the first drum 110 to stably rotate during high-speed spinning.

The first driving shaft 141 may be disposed between the first drum 110 and the first driving motor 140. One end of the first driving shaft 141 is connected to a rear panel of the first drum 110, and the other end of the first driving shaft 141 is extended outward from a rear wall of the first tub 120. When the first driving motor 140 drives the first driving shaft 141, the first drum 110 connected to the first driving shaft 141 rotates around the first driving shaft 141.

A bearing housing 142 may be installed at the rear wall of the first tub 120 to rotatably support the first driving shaft 141. The bearing housing 142 may be formed of an aluminum alloy and may be inserted into the rear wall of the first tub 120 when the first tub 120 is injection-molded. Bearings 143 are installed between the bearing housing 142 and the first driving shaft 141 to allow the first driving shaft 141 to smoothly rotate.

The washing machine 1 may include a function of washing with water at high temperature. To obtain the water at high temperature, a heater 180 capable of heating washing water or rinsing water accommodated in the first tub 120 may be disposed at a bottom surface of the first tub 120.

The washing machine 1 may include a first drain pump 170 disposed below the first tub 120 to discharge water in the first tub 120 outward from the washing machine 1, a first connecting hose 171 which connects a first drain hole 173 of the first tub 120 to the first drain pump 170 to allow the water in the first tub 120 to flow into the first drain pump 170, a circulating hose 174 which connects the first drain pump 170 to the first tub 120 to circulate the water which flows into the first drain pump 170 through the first tub 120, and a first drain hose 172 which guides water pumped by the first drain pump 170 to the outside of the washing machine 1.

The washing machine 1 may include a front cover 40 at which a first insertion hole 41 for inserting laundry into the first washing space 115 is disposed, and a first door 160 for opening and closing the first insertion hole 41 may be coupled to the front cover 40.

The first door 160 may be provided corresponding to the first insertion hole 41 and may be provided to be pivotable with respect to the front cover 40. The first door 160 may include a first door frame 161, a first door cover 162, and door glass 163.

The first door frame 161 has an approximately annular shape in the embodiment but may have an approximately quadrangular shape. The first door cover 162 and the door glass 163 may be formed of transparent materials to allow an inside of the first drum 110 to be seen from the outside of the washing machine 1 even when the first door 160 closes the first insertion hole 41. The door glass 163 may be disposed to convexly protrude from the first door frame 161 toward the inside of the first drum 110. Through the configuration, the door glass 163 may be inserted into the first insertion hole 41 when the first door 160 is closed.

A first hinge is provided near the first insertion hole 41 and coupled to a first hinge coupler formed on one side of the first door frame 161 to allow the first door 160 to pivot with respect to the front cover 40. A first hook 166 is provided on the other side of the first door frame 161 and a first hook accommodating portion 42 is provided at the front cover 40 corresponding to the first hook 166 such that the first door 160 may remain in a state of closing the first insertion hole 41.

To insert laundry into the first washing space 115 even when the first door 160 is closed, the first door 160 may include an auxiliary laundry insertion hole 167 and an auxiliary door 164 for opening and closing the auxiliary laundry insertion hole 167. The auxiliary door 164 may be pivotably mounted on the first door cover 162.

To insert laundry into the washing machine 1 through the auxiliary laundry insertion hole 167 of the first door 160, it is necessary to allow the laundry to pass through the door glass 163. For this, the door glass 163 includes a glass through hole 168. As an alternative, it is possible to configure door glass not to be disposed in the rear of the auxiliary laundry insertion hole 167 by recessing a top of the door glass.

The first door 160 may include a connection guide 165 to connect the auxiliary laundry insertion hole 167 of the first door 160 to the glass through hole 168 of the door glass 163. The connection guide 165 may have a pipe shape with both ends open and a hollow.

In detail, one end of the connection guide 165 is connected to the auxiliary laundry insertion hole 167, and the other end is connected to the glass through hole 168. In the embodiment, the connection guide 165 may be tilted downward from a front to a rear. That is, the one end of the connection guide 165 connected to the auxiliary laundry insertion hole 167 may be at a position higher than that of the other end thereof. Through the configuration, a user may easily insert laundry into the first drum 110 through the auxiliary laundry insertion hole 167.

The first door 160 has been described as including the auxiliary door 164 in the embodiment but is not limited thereto. The first door 160 may be configured without an auxiliary laundry insertion hole, an auxiliary door, a connection guide, and the like.

The washing machine 1 may include a diaphragm 121 disposed between the first insertion hole 41 of the front cover 40 and the opening 123 of the first tub 120. The diaphragm 121 may form a path from the first insertion hole 41 to the opening 114 of the first drum 110 and reduce vibrations transferred to the front cover 40 during rotation of the first drum 110. Also, a part of the diaphragm 121 may be disposed between the first door 160 and the front cover 40 to prevent washing water in the first tub 120 from leaking outward from the washing machine 1.

The washing machine 1 may include a second drum 210 in which the second washing space 215 is formed and a second tub 220 which accommodates the second drum 210 and stores washing water or rinsing water to be used in a washing operation or a rinsing operation. The second drum 210 and the second tub 220 may have a cylindrical shape with at least partially opened one surface and may be disposed to allow the opened one surface to face upward.

The washing machine 1 may include a second housing 230 in which the second drum 210 and the second tub 220 are disposed and which includes an open bottom. In detail, the second housing 230 may include a lower frame 231 which includes a top and a bottom open and supports the second tub 220 and an upper frame 232 which includes a second insertion hole 234 for inserting laundry into the second washing space 215 and is mounted above the lower frame 231. Also, the second housing 230 may include side covers 233 which form exteriors of a left surface and a right surface.

The washing machine 1 may include a second door 260 disposed at the second housing 230 to open and close the second insertion hole 234. The second door 260 may be provided corresponding to the second insertion hole 234 and may be provided to be pivotable with respect to the upper frame 232. The second door 260 may include a second door frame 261 and a second door cover 262. The second door cover 262 may be formed of a transparent material to allow the second tub 220 and the second drum 210 to be seen from the outside of the washing machine 1 even when the second door 260 closes the second insertion hole 234.

To allow the second door 260 to pivot with respect to the upper frame 232, second hinges are provided at both left and right sides of the second door frame 261 and coupled to second hinge couplers formed around the second insertion hole 234. A latch accommodating portion 263 is provided at a front of the second door frame 261 and a latch device is provided at the upper frame 232 corresponding to the latch accommodating portion 263 of the second door frame 261 such that the second door 260 may remain in a state of closing the second insertion hole 234.

The second drum 210 may be provided to have a cylindrical shape with an open top and be disposed to be rotatable in the second tub 220. A plurality of second through holes 211 for a flow of washing water may be formed at side surfaces and a bottom surface of the second drum 210. A second balancer 212 may be mounted on a top of the second drum 210 to allow the second drum 210 to stably rotate during high-speed spinning. A filter 300 provided to filter out foreign substances which may occur during washing may be attached to an inner surface of the second drum 210.

A curve portion 213 for generating water currents may be formed at the bottom surface of the second drum 210. Although not shown in the drawings, the washing machine 1 may further include a pulsator disposed in the second drum 210 to generate water currents.

The second tub 220 may have a cylindrical shape and be supported by suspension devices 250 to the lower frame 231. In detail, the second tub 220 may be supported by four suspension devices 250 to be suspended from the lower frame 231. A third insertion hole 214 may be provided at a top surface of the second tub 220 corresponding to the second insertion hole 234, and a third door 280 for opening and closing the third insertion hole 214 may be coupled thereto.

The third door 280 may include a third door frame 281 and a third door cover 282. The third door cover 282 may be formed of a transparent material to allow an inside of the second drum 210 to be seen from an outside of the second tub 220 even when the third door 280 closes the third insertion hole 214.

A third hinge is provided near the third insertion hole 214 and coupled to a third hinge coupler formed at one side of the third door frame 281 to allow the third door 280 to pivot with respect to the second tub 220. A handle 283 capable of opening the third door 280 may be provided at the other side of the third door frame 281, and a second hook 284 may be provided at the handle 283. A second hook accommodating portion is provided at the second tub 220 corresponding to the second hook 284 such that the third door 280 may remain in a state of closing the third insertion hole 214. When the handle 283 is pulled, the second hook 284 may be separated from the second hook accommodating portion and open the third door 280.

The washing machine 1 may include a second driving motor 240 disposed outside a bottom of the second tub 220 to rotate the second drum 210. A second driving shaft 241 for transmitting power of the second driving motor 240 may be connected to the bottom surface of the second drum 210. One end of the second driving shaft 241 is connected to a bottom panel of the second drum 210, and the other end of the second driving shaft 241 is extended outward from a bottom wall of the second tub 220. When the second driving motor 240 drives the second driving shaft 241, the second drum 210 connected to the second driving shaft 241 rotates around the second driving shaft 241.

Although not shown in the drawings, when the pulsator is disposed at the bottom surface of the second drum 210, the washing machine 1 may further include a power switching device to simultaneously or selectively transfer a driving force generated from the second driving motor 240 to the second drum 210 and the pulsator.

The washing machine 1 may include a second drain pump 270 disposed below the second tub 220 to discharge water in the second tub 220 to the outside of the washing machine 1 and a second drain hose 272 which guides the water pumped by the second drain pump 270 to the outside of the washing machine 1. In detail, the second drain pump 270 may be mounted above the first housing 130.

A second drain hole 273 capable of draining water in the second tub 220 may be formed at a bottom surface of the second tub 220. The second drain hole 273 and the second drain pump 270 may be connected by a second connecting hose 271 to allow the water in the second tub 220 to flow into the second drain pump 270.

The washing machine 1 may include a water supply device 400 capable of supplying washing water to the first tub 120 and the second tub 220. The water supply device 400 may be disposed at the second housing 230. In detail, the water supply device 400 may be disposed at the upper frame 232 or preferably, may be disposed in the rear of the second insertion hole 234.

Also, the washing machine 1 may include a detergent supply device 500 capable of supplying a detergent to the first tub 120. The detergent supply device 500 may be disposed at the second housing 230. In detail, the detergent supply device 500 may be disposed at the upper frame 232 or preferably, may be disposed in the front of the second insertion hole 234.

The washing machine 1 may include a fixing bracket 30 which couples the first housing 130 and the second housing 230 not to be separated. The fixing bracket 30 may be coupled to a front of the first housing 130 and a front of the second housing 230.

Also, the washing machine 1 may include a control panel 50 disposed above the front cover 40 to operate the washing machine 1. The control panel 50 may include an inputter which receives an operation command of the washing machine 1 from the user and a display which displays operation information of the washing machine 1.

Referring to FIGS. 1 to 3, the second housing 230 including the second tub 220 therein may be mounted above the first housing 130 including the first tub 120 therein. Accordingly, an internal space of the washing machine 1 may be divided into a lower area in which the first tub 120 is disposed and which is comparted by the first housing 130 and an upper area in which the second tub 220 is disposed and which is comparted by the second housing 230.

In the washing machine 1 according to one embodiment of the present disclosure, the second drain pump 270 configured to drain water from the second tub 220 disposed in the upper area may be disposed in the lower area to efficiently utilize the internal space. That is, the second drain pump 270 configured to drain water from the second tub 220 disposed in the second housing 230 may be disposed in the first housing 130.

Figure 4:
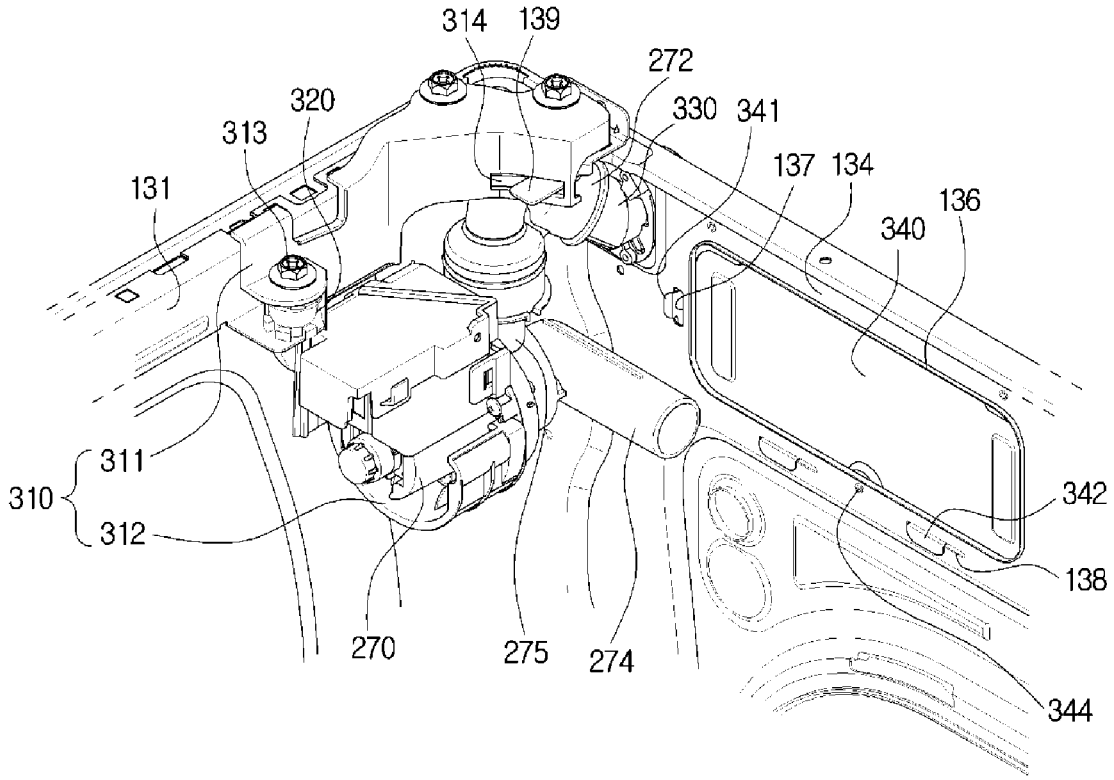
FIG. 4 is an enlarged view illustrating a part of a first housing of the washing machine shown in FIG. 2.
Figure 5:
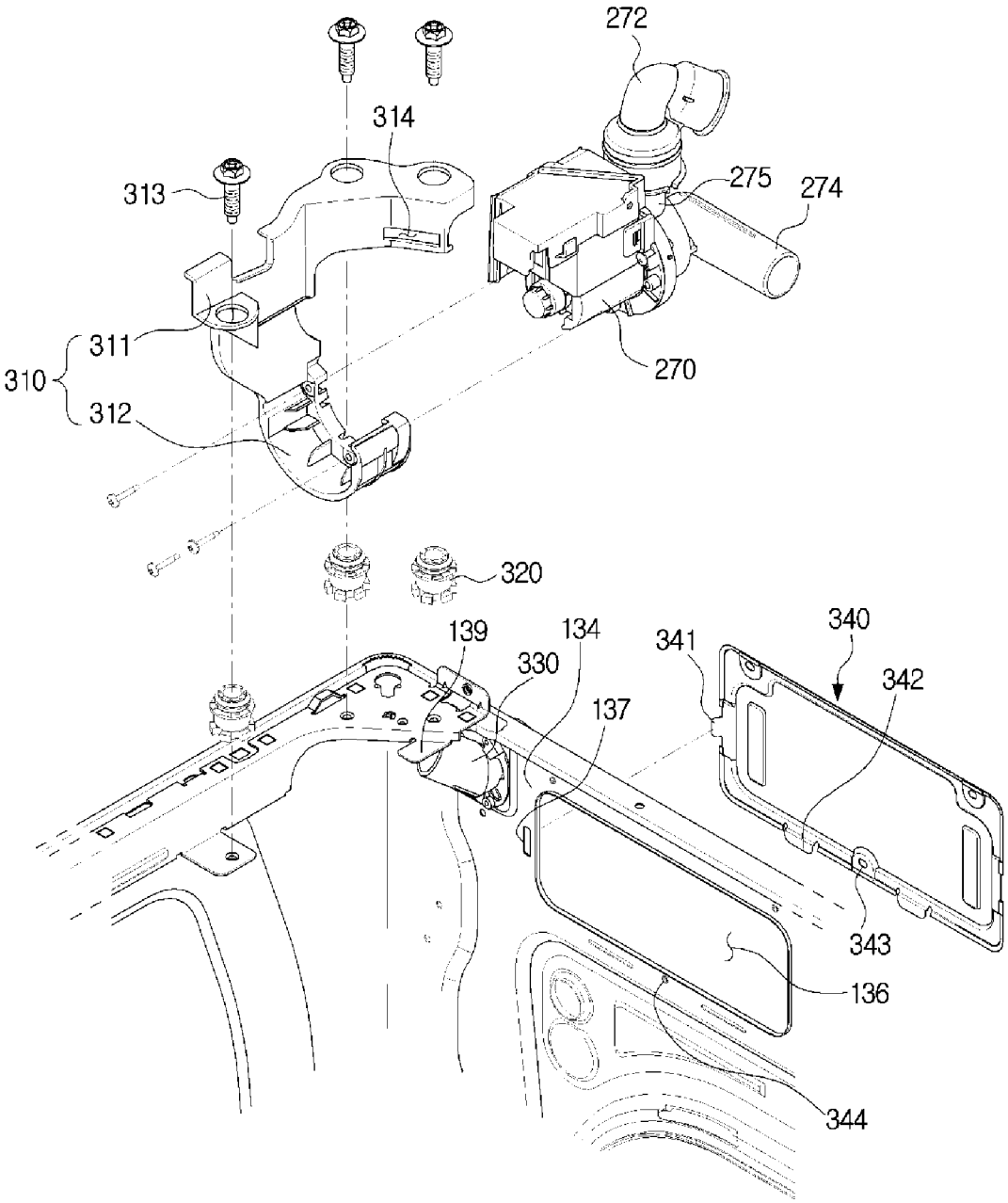
FIG. 5 is an exploded view illustrating the part of the first housing of the washing machine shown in FIG. 4.
Figure 6:
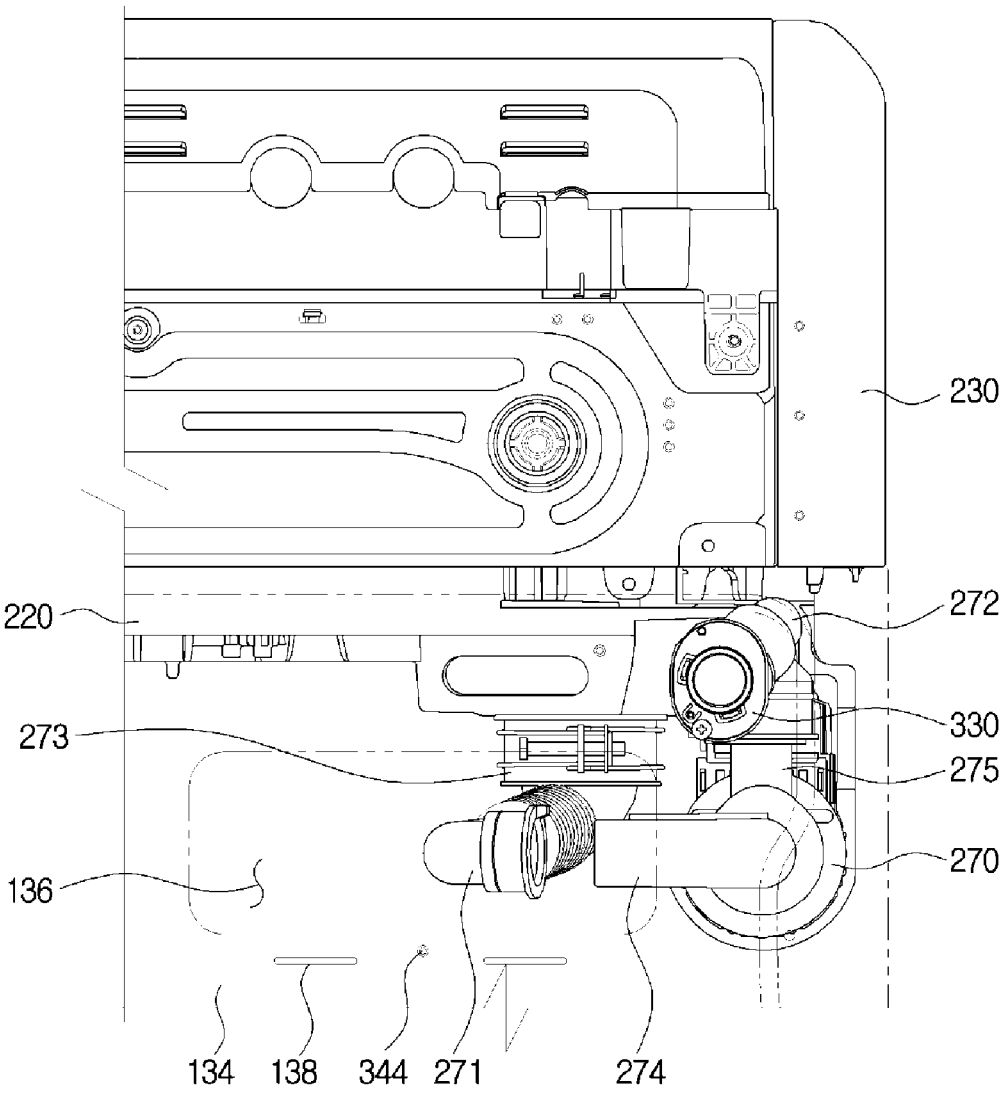
FIG. 6 is an enlarged view illustrating a part of a rear surface of the washing machine shown in FIG. 1.

FIG. 4 is an enlarged view illustrating a part of the first housing of the washing machine shown in FIG. 2. FIG. 5 is an exploded view illustrating the part of the first housing of the washing machine shown in FIG. 4. FIG. 6 is an enlarged view illustrating a part of a rear surface of the washing machine shown in FIG. 1.

Referring to FIGS. 4 to 6, the second drain pump 270 may be mounted above the first housing 130. The second drain pump 270 may include an inlet pipe 274 into which water of the second tub 220 may flow and an outlet pipe 275 from which water pumped by the second drain pump 270 may be discharged.

The second connecting hose 271 which connects the second tub 220 to the second drain pump 270 may be connected to the inlet pipe 274 of the second drain pump 270. The second drain hose 272 which guides water pumped by the second drain pump 270 to the outside of the washing machine 1 may be connected to the outlet pipe 275 of the second drain pump 270.

The washing machine 1 may include a pump bracket 310 capable of mounting or connecting the second drain pump 270 on or to the first housing 130. The pump bracket 310 may support the second drain pump 270 to dispose the second drain pump 270 in the first housing 130.

The pump bracket 310 may include a pump coupler 312 to which the second drain pump 270 may be coupled and a housing coupler 311 which may be coupled to the first housing 130. A position at which the pump bracket 310 is coupled to the first housing 130 may be higher than a position of a lowermost part of the second drain pump 270. That is, the housing coupler 311 of the pump bracket 310 may be disposed higher than the pump coupler 312.

In detail, the second drain pump 270 may be mounted on the pump coupler 312 of the pump bracket 310 and be fixed by a fastening member such as a screw and the like. Also, the housing coupler 311 of the pump bracket 310 may be coupled to a top end of a corner to which the first side panel 131 and the rear panel 134 of the first housing 130 are connected.

At least part of the pump bracket 310 may be disposed between the first housing 130 and the second housing 230. In detail, the housing coupler 311 of the pump bracket 310 may be coupled to a top end of the first housing 130 and may be disposed between the first housing 130 and the second housing 230.

A position at which the second drain pump 270 is coupled to the first housing 130 is not limited to the top end of the corner to which the first side panel 131 and the rear panel 134 are connected, and the second drain pump 270 may be mounted on a top of the first side panel 131 or a top of the rear panel 134 as necessary. Also, the pump bracket 310 may be connected to or mounted on the second housing 230. The pump bracket 310 may support the second drain pump 270 to dispose the second drain pump 270 in the second housing 230. When the pump bracket 310 is coupled to the second housing 230, a position at which the pump bracket 310 is coupled to the second housing 230 may be higher than a position of a lowermost part of the second drain pump 270.

The first housing 130 may include a coupling flange 139 provided at a top end of the rear panel 134, and a flange through hole 314 through which the coupling flange 139 may pass may be provided at the housing coupler 311 of the pump bracket 310. When the pump bracket 310 is temporarily mounted on the first housing 130 to allow the coupling flange 139 of the first housing 130 to pass through the flange through hole 314 of the pump bracket 310, the pump bracket 310 to which the second drain pump 270 is coupled may be easily fixed to the first housing 130.

Although the coupling flange 139 of the first housing 130 is shown as protruding from the rear panel 134 in the drawings, a position at which the coupling flange 139 is disposed is not limited thereto. As necessary, the coupling flange 139 may be provided to protrude from the first side panel 131, and the flange through hole 314 of the pump bracket 310 may be provided at a position corresponding to the position of the coupling flange 139.

The pump bracket 310 may include a vibration elimination member 320 to prevent vibrations generated by the second drain pump 270 from being transferred to the first housing 130. The vibration elimination member 320 may include an elastic material and be mounted on the housing coupler 311 of the pump bracket 310. The pump bracket 310 may be mounted on the first housing 130 by a fastening member 313 which allows the vibration elimination member 320 to be disposed between the housing coupler 311 and the first housing 130 and passes through the vibration elimination member 320.

The first housing 130 may include an opening 136 formed at a position corresponding to a position at which the second drain pump 270 is disposed, to approach (access) the second drain pump 270 from the outside of the first housing 130. In detail, the opening 136 through which the second drain pump 270 may be approached from the outside of the first housing 130 may be provided at the rear panel 134 of the first housing 130. A position of the opening 136 provided at the first housing 130 is not limited to the rear panel 134 and may be provided at the first side panel 131 as necessary.

Since the second drain pump 270 disposed at the first housing 130 is a component for draining water in the second tub 220 disposed in the second housing 230, it is necessary to couple the first housing 130 to the second housing 230 and then couple the second connecting hose 271 connected to the second tub 220 to the second drain pump 270. After the second housing 230 is mounted on a top of the first housing 130, the inlet pipe 274 of the second drain pump 270 and the second connecting hose 271 are approached from the outside of the first housing 130 through the opening 136 provided at the first housing 130 to connect the second connecting hose 271 to the inlet pipe 274 of the second drain pump 270. Also, the opening 136 provided at the first housing 130 may be utilized to maintain and manage the second drain pump 270 after the first housing 130 and the second housing 230 are coupled.

The first housing 130 may include a cover 340 capable of opening and closing the opening 136 provided at the first side panel 131 or the rear panel 134. The first housing 130 may include a cover coupler through which the cover 340 may be coupled to the first side panel 131 or the rear panel 134 at which the opening 136 is provided, and the cover 340 may include an L-shaped latch provided to be inserted into the cover coupler.

In detail, the first side panel 131 or the rear panel 134 of the first housing 130 may include a hole-shaped bottom coupler 138 provided below the opening 136 and a hole-shaped side coupler 137 provided on the left or right of the opening 136. The cover 340 may include an L-shaped bottom latch 342 provided below the cover 340 and extended downward to be inserted into the bottom coupler 138 and an L-shaped side latch 341 provided on the left or right of the cover 340 and extended leftward or rightward to be inserted into the side coupler 137.

The cover 340 may be coupled to the first side panel 131 or the rear panel 134 by primarily inserting the bottom latch 342 into the bottom coupler 138, secondarily inserting the side latch 341 into the side coupler 137, and thirdly sliding the cover 340 leftward or rightward to be coupled to the first side panel 131 or the rear panel 134 of the first housing 130.

The bottom coupler 138 may be formed in a hole longer than the bottom latch 342 to allow the cover 340 to slidably move.

After the cover 340 is coupled to the first side panel 131 or the rear panel 134 of the first housing 130, a first fixer 343 provided at the cover 340 and a second fixer 344 provided at the first side panel 131 or the rear panel 134 of the first housing 130 are fastened by using a fastening member such as a screw and the like such that the cover 340 may be fixed to the first housing 130.

The first housing 130 may include a drain bracket 330 disposed passing through the first housing 130 and to which the second drain hose 272 may be connected. In detail, the first housing 130 may include the drain bracket 330 disposed at the first side panel 131 or the rear panel 134 of the first housing 130 to be adjacent to the second drain pump 270. Water pumped by the second drain pump 270 may be discharged outward from the washing machine 1 through the second drain hose 272 connected to the drain bracket 330 disposed at the first housing 130.

As is apparent from the above description, a washing machine according to one embodiment of the present disclosure includes a plurality of washers to separate and wash laundry as necessary.

A washing machine according to one embodiment of the present disclosure may efficiently utilize an internal space of the washing machine.

The scope of the present disclosure is not limited to the particular embodiments described above. Various other embodiments correctable or modifiable by one of ordinary skill in the art within a range without departing from the essence as the technical concept of the present disclosure defined by the claims are also included in the scope of the present disclosure.

What is claimed is:

1. A washing machine comprising:

a first housing in which a first tub is disposed, the first housing having an open top and an opening formed in the first housing;

a second housing in which a second tub is disposed, the second housing having an open bottom, and the second housing mounted on an upper portion of the first housing;

a water supply positioned in the second housing and configured to supply water to the first tub and the second tub;

a fixing bracket configured to couple the first housing to the second housing;

a first drain pump disposed in the first housing, the first drain pump being configured to drain water from the first tub;

a second drain pump disposed in the upper portion of the first housing and positioned in a space between the first tub and the second tub, the second drain pump configured to drain water from the second tub through a connecting hose, the connecting hose connecting the second tub to the second drain pump and the second drain pump being accessible through the opening; and a pump bracket configured to mount the second drain pump in the first housing, wherein the pump bracket includes a housing coupler coupleable to the first housing and positioned between the first housing and the second housing.

2. The washing machine of claim 1, wherein the second drain pump comprises an inlet pipe connectable to the connecting hose, and wherein through the opening the connecting hose and the inlet pipe are accessible from an outside of the first housing.

3. The washing machine of claim 2, wherein the first housing further comprises a cover configured to open and close the opening of the first housing.

4. The washing machine of claim 1, wherein the pump bracket comprises a pump coupler to which the second drain pump is coupleable.

5. The washing machine of claim 4, wherein the first housing comprises a side panel which forms a side surface of the first housing and a rear panel which forms a rear surface of the first housing, and wherein the housing coupler of the pump bracket is connectable to a top end of a corner to which the side panel and the rear panel of the first housing are connected.

6. The washing machine of claim 5, wherein the first housing further comprises a coupling flange provided at a top end of the side panel or the rear panel, and wherein the pump bracket further comprises a flange through hole provided at the housing coupler and through which the coupling flange passes.

7. The washing machine of claim 4, wherein the pump bracket further comprises a vibration elimination member mounted on the housing coupler, and wherein the vibration elimination member is disposed between the housing coupler and the first housing.

8. The washing machine of claim 7, wherein the vibration elimination member comprises an elastic material.

9. The washing machine of claim 1, further comprising a drain hose which guides water pumped by the second drain pump to an outside of the washing machine, wherein the second drain pump further comprises an outlet pipe connectable to the drain hose, and wherein the first housing comprises a drain bracket passing through the first housing and connectable to the drain hose.

10. The washing machine of claim 1, wherein the first tub comprises a first opening for inserting laundry, at a front thereof, and wherein the second tub comprises a second opening for inserting laundry, at a top thereof.

11. The washing machine of claim 1, wherein an internal space of the washing machine includes the first tub in the first housing that is separated from the second tub in the second housing.

12. The washing machine of claim 1, wherein the washing machine operates as a front-loading washing machine using the first tub and operates as a top-loading washing machine using the second tub.

13. The washing machine of claim 1, wherein the fixing bracket is coupled to a front of the first housing and a front of the second housing.

14. A washing machine comprising:

a lower area comparted by a first housing, the first housing having a first tub disposed therein and an opening formed in the first housing;

an upper area comparted by a second housing, the second housing having a second tub disposed therein, and the second housing mounted on an upper portion of the first housing;

a water supply positioned in the second housing and configured to supply water to the first tub and the second tub;

a fixing bracket configured to couple the first housing to the second housing;

a first drain pump disposed in the lower area, the first drain pump being configured to drain water from the first tub disposed in the lower area;

a second drain pump disposed in the lower area and positioned in a space between the first tub and the second tub, the second drain pump being configured to drain water from the second tub disposed in the upper area through a connecting hose, the connecting hose connecting the second tub to the second drain pump and the second drain pump being accessible through the opening; and a pump bracket configured to mount the second drain pump in the first housing, wherein the pump bracket includes a housing coupler coupleable to the first housing and positioned between the first housing and the second housing.

15. The washing machine of claim 14, wherein the first housing comprises a side panel which forms a side surface of the first housing and a rear panel which forms a rear surface of the first housing, wherein the second drain pump is mounted at a top of the side panel or rear panel, and wherein the side panel or the rear panel of the first housing comprises the opening formed at a position at which the second drain pump is disposed, to allow the second drain pump to be accessed from the outside of the first housing.

16. The washing machine of claim 15, wherein the first housing further comprises a cover configured to open and close the opening and a cover coupler to which the cover is coupleable, and wherein the cover comprises a latch configured to be inserted into the cover coupler.

17. The washing machine of claim 15, wherein the first housing further comprises a drain bracket disposed at the side panel or the rear panel and to which a drain hose, which guides water pumped by the second drain pump to the outside of the washing machine, is connectable.

18. A washing machine comprising:

a first housing in which a first tub is disposed, the first housing having an open top and an opening formed in the first housing;

a second housing in which a second tub is disposed, the second housing having an open bottom, and the second housing mounted on an upper portion of the first housing;

a water supply positioned in the second housing and configured to supply water to the first tub and the second tub;

a fixing bracket configured to couple the first housing to the second housing;

a drain pump positioned in a space between the first tub and the second tub and configured to drain water stored in the second tub to an outside of the second housing though a connecting hose, the connecting hose connecting the second tub to the drain pump and the drain pump accessible through an opening formed in the first housing; and a pump bracket configured to connect the drain pump to the first housing or the second housing, wherein the pump bracket includes a housing coupler coupleable to the first housing and positioned between the first housing and the second housing.

* * * * *